United States Patent [19]

Bear

[11] Patent Number: 4,704,833

[45] **Date of Patent: * Nov. 10, 1987**

[54] PREFORMED SOFFITS FOR INTERIOR CONSTRUCTION

[75] Inventor: Richard W. Bear, Cedar Rapids, Iowa

[73] Assignee: Epsco, Inc., Cedar Rapids, Iowa

[ * ] Notice: The portion of the term of this patent subsequent to Apr. 29, 2003 has been disclaimed.

[21] Appl. No.: 897,202

[22] Filed: Aug. 18, 1986

[51] Int. Cl.[4] ..... E04C 1/00

[52] U.S. Cl. ..... 52/309.2; 52/220; 52/309.7; 52/727

[58] Field of Search ..... 52/309.2, 220, 281, 52/282, 309.7, 309.8, 376, 375, 727, 730, DIG. 8

[56] References Cited

U.S. PATENT DOCUMENTS 4,584,807 4/1986 Bear ..... 52/309.2

*Primary Examiner*—Carl D. Friedman
*Assistant Examiner*—Naoko N. Slack
*Attorney, Agent, or Firm*—Simmons, Perrine, Albright & Ellwood

[57] ABSTRACT

Soffits for interior construction purposes are preformed from L-shaped foam material having insert furring strips for attaching the soffits to walls and ceilings. The preformed soffits are brought to the job site, quickly cut to length, fastened in place, and then covered with plasterboard before cabinets are mounted below.

6 Claims, 4 Drawing Figures

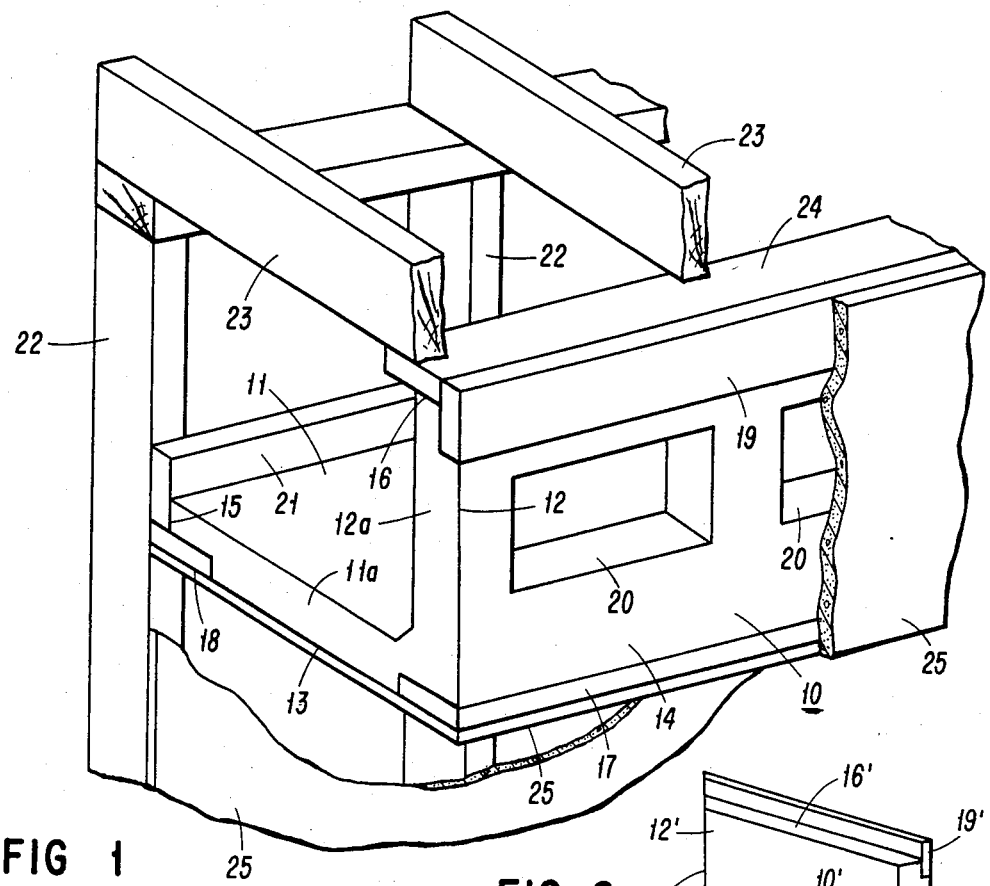
FIG 1
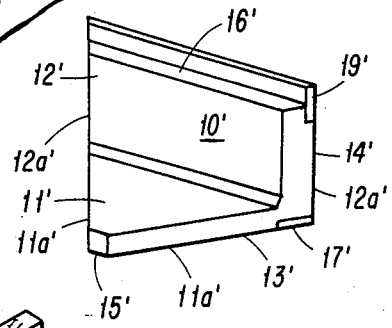
FIG 2
FIG 3
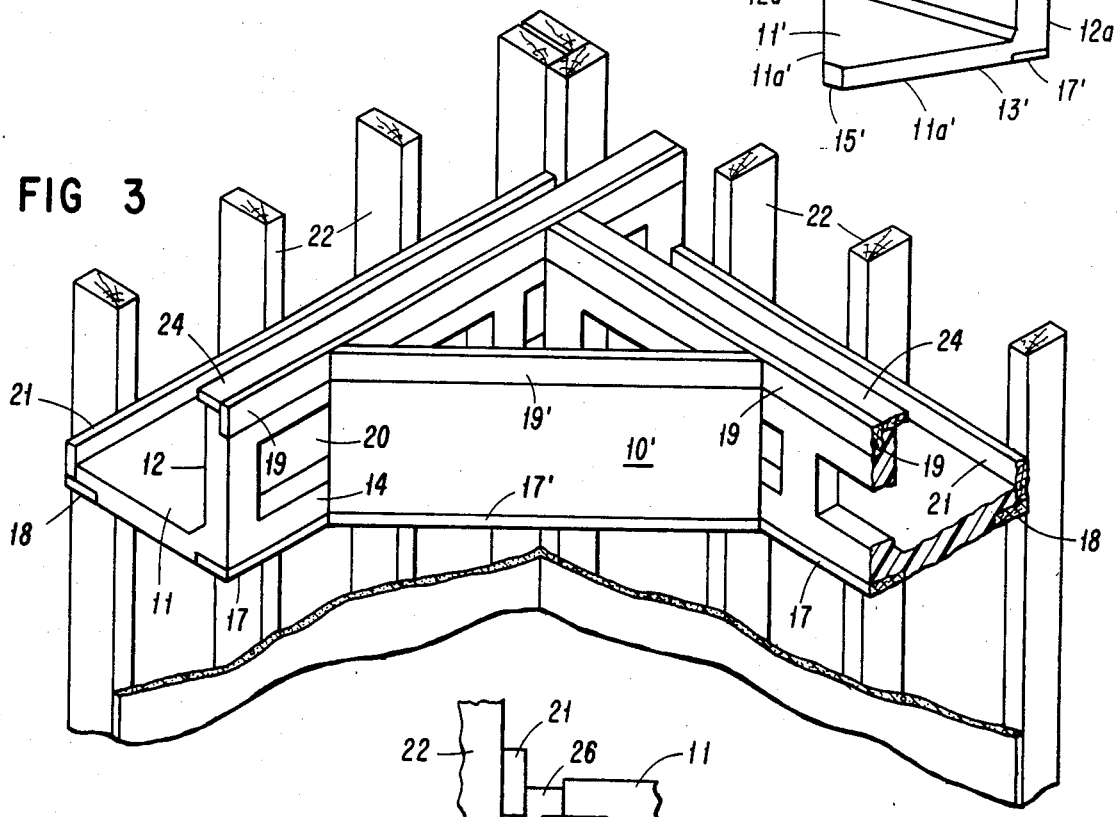
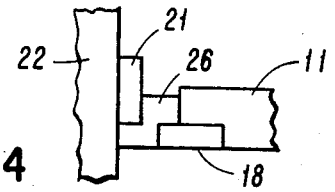
FIG 4

PREFORMED SOFFITS FOR INTERIOR CONSTRUCTION

BACKGROUND OF THE INVENTION

Soffits used in interior construction for enclosing the space above kitchen cabinets and the like, for example, are currently, so far as known, constructed on the job piece-by-piece. This is laborious and time consuming, requiring the measuring, cutting and assembling in place of a multitude of lengths of wooden components usually of two-by-four size, to form a framework whose outer surfaces are then covered with plasterboard such as SHEETROCK. For instance, just to frame up a straight, eight foot length of soffit can easily need three to four hours even by a skilled carpenter. To do the same for a corner is even harder and proportionately more time consuming because of the angles involved. The space enclosed by a soffit, though sometimes used for duct work and electrical cables, is otherwise useless so that the cost in time and materials is great for what largely serves only a cosmetic function.

My U.S. Pat. No. 4,584,807 issued Apr. 29, 1986, whose disclosure is incorporated herein, illustrates my initial solution to the foregoing by providing a selection of preformed soffits which can be brought to the job, easily cut to length and quickly installed. Those soffits consist essentially of lengths of U-shaped molded material, such as styrene foam, having wooden furring strips inset into and glued to the foam at certain of the exterior longitudinal corners of the soffits. The furring strips serve variously as anchor points for the soffits to a ceiling, as suspension points for the cabinets below, and as nailing points for the plasterboard with which the exterior faces of the soffits are later covered in the usual manner. Four types of soffits of this general nature are provided in my prior patent, a wall type for fitting in the corner between a wall and a ceiling, two "island" types for suspension from a ceiling, one for a single row and the other for a double row of cabinets below, and a corner type for fitting in a corner between two walls. Preferably, the exterior vertical faces of the soffits are provided with spaced apertures along their lengths so that electrical cables can be readily threaded along the interior of the soffits after their installation. Installation involves merely cutting the soffit to proper length and then fastening it in position with nails (or other fasteners) and glue. In some cases wall or ceiling cleats are also necessary. Typically, no more than about a half hour should be required to install one of the eight foot soffits of my prior patent, a great saving compared with framing up a soffit in the current manner.

While the wall type soffit shown in FIG. 1 of my prior patent is suitable for either new construction or for remodeling of previous construction, I have since realized that it is more elaborate than is really necessary in the case of new construction, that is, where the soffit can be installed before sheeting or plastering of the wall and ceiling. I have also since realized that the corner type soffit shown in FIG. 4 of that patent can be greatly simplified for use in both new and remodeling installation. The two "island" types of soffits shown in FIGS. 2 and 3 of the patent remain suitable for either kind of installation.

Accordingly, the chief objects of the present invention are simpler versions of the wall and corner type soffits of my prior patent for use in new construction.

SUMMARY OF THE INVENTION

The present invention simplifies the wall and corner type soffits of my prior patent by eliminating one of the "legs" of each so that they both are now of L-shape rather than of U-shape configuration in cross-section. In the case of the wall type, furring strips are provided at the three exterior longitudinal corners of the soffit and since in new construction there is no plaster or other sheeting on the wall or ceiling, appropriate cleats can easily be nailed to the wall studs and the ceiling joists into which the furring strips of the soffit can be nailed. In the case of the corner type, instead of butting wall type soffits against a corner soffit, as shown in FIG. 4 of my prior patent, rather the end of one wall type is simply butted against the vertical face of another wall type at the corner between two walls, the new corner type, being a right triangle in plan view, is then merely fitted into the corner between the two wall types and butts against the vertical faces of the latter. The new corner type is provided with furring strips only at its upper and lower edges which are secured in turn to those of the wall type. During remodeling construction when the wall type soffits of FIG. 1 of my prior patent are used, the same construction can be used at a corner between two walls so that the new corner type soffit can be employed in that instance also since neither the corner nor the wall type needs support the weight of a cabinet below, the latter instead being hung from the walls rather than the soffits.

Other features and advantages of the invention will appear from the drawings and the more detailed description which follows.

BRIEF DESCRIPTION OF THE DRAWINGS

FIG. 1 is an isometric view of my new wall type soffit shown installed in the corner between a wall and ceiling during new construction, certain portions being broken away for illustrative purposes.

FIG. 2 is an isometric view of my new corner soffit.

FIG. 3 is an isometric view illustrating my new corner soffit and the manner of the installation of it and a pair of wall type soffits in a corner between two walls.

FIG. 4 is a detail view illustrating the manner of accommodating cabinets of greater depth.

DETAILED DESCRIPTION OF THE PREFERRED EMBODIMENT

Turning first to FIG. 1 the bulk of my new wall type soffit consists of an integral length of styrene foam 10 of L-shaped configuration in cross-section, a suitable foam being one pound STYROFOAM. Preferably the foam 10 is molded to shape but alternately it could be hot wire cut in well-known manner from 48"×48"×96" blocks in which such foam is commercially available or it could be extruded. The legs 11 and 12 of each length of foam 10 have transverse end faces 11*a* and 12*a* and rectangular exterior planar surfaces 13 and 14, the latter intersecting each other at a right angle to form the outer faces of the legs 11 and 12. The longitudinal outer end faces 15 and 16 of the legs 11 and 12 are also planar and at right angles to the leg surfaces 13 and 14. The exterior longitudinal corners of the foam 10 at the juncture between the legs surfaces 13 and 14, and the outer longitudinal exterior corners of the legs 11 and 12, are formed by wooden furring strips 17, 18 and 19, respectively, extending the length of the foam 10. The furring strips 17, 18 and 19, which may be wood, are disposed as shown in FIG. 1, being preferably inset into and glued to the foam 10 by virtue of recesses incorporated during the shaping of the foam 10, so that their respective exterior surfaces form portions of the leg surfaces 13 and 14. The furring strips 18 and 19, however, overlap the leg end surfaces 15 and 16 for purposes to be described, and the leg 12 may be apertured at regular spaced intervals 20 along its length.

The foam 10 is dimensioned so that the soffit will readily accommodate standard cabinets or the like. For kitchen cabinets the depth of the leg 11 may be $11\frac{7}{8}$th inches, the height of the leg 12, $10\frac{3}{8}$ inches, and the thickness of the legs 11 and 12, $1\frac{1}{2}$ inches. The furring strips 17, 18 and 19 may be each $2\frac{1}{4}''$ by $\frac{3}{4}''$ in cross-section and the overlap of the strips 18 and 19, $\frac{3}{4}$ inches, whereby the overall depth and height of the legs 11 and 12 are $12\frac{5}{8}$ inches and $11\frac{1}{8}$ inches, respectively. Preferably the soffits are provided in convenient preformed four-foot lengths which are readily transported to the job site.

Installation in the case of new construction is a simple, straightforward task. First a cleat 21 is nailed to the wall studs 22 at the proper distance from the ceiling joists 23, and a second cleat 24 nailed to the joists 23 at the proper distance from the studs 22. (If the joists 23 run parallel to the soffit, bridges between the joists may be necessary in order to anchor the cleats 24.) One or more soffits are then cut to proper length and placed in position as shown in FIG. 1. Nails or other fasteners are then driven up through the furring strip 18 into the wall cleat 21, and through the strip 19 into the ceiling cleat 24. Next the leg surfaces 13 and 14 (as well as the ceiling and wall) are covered with plasterboard 25 nailed into the furring strips 17, 18 and 19. Finally, after finishing off the plasterboard 25 in the usual dry-wall manner, the cabinets are positioned and secured to the wall studs 22 below the soffit. Since some kitchen cabinets are greater in depth than others, that can be accommodated by inserting offset filler strips 26 between the legs 11 and the furring strips 18, on the one hand, and the wall cleats 21 and the studs 22 on the other, as shown in FIG. 4.

The new corner type soffit illustrated in FIG. 2 is essentially similar to the wall type of FIG. 1 and similar parts bear primed reference numerals. The principal differences are that the transverse ends 11*a*′ and 12*a*′ are at right angles to each other and to the leg surface 13′ but at a 45 degree angle with respect to the other leg surface 14′, and no furring strip is used at the outer end of the leg 11′. Dimensionwise, the overall height of the corner leg 12′ is the same as that of the wall leg 12, namely $11\frac{1}{8}$ inches, its length $16\frac{1}{2}$ inches, and the perpendicular depth of the leg 11′ $7\frac{3}{4}$ inches. Corner installation of the new wall and corner type soffits is shown in FIG. 3 where it will be seen that the end of one wall type butts against one of the corner walls while the end of the other wall type butts against the face 14 of the former, both being installed to the walls and ceiling in the manner described above. The corner type then simply bridges the faces 14 of the two wall soffits, the corner furring strips 17′ and 19′ being secured to the wall furring strips 17 and 19. Installation of the new corner type in conjunction with the wall type soffits of my prior patent during remodeling construction is the same as that in the case of new construction.

As in the case of the soffits of my prior patent, the interiors of the new wall type soffits can be utilized as a duct or ducts for various purposes and the apertures 20 serve for access to the interiors of the soffits for threading electrical wiring or installing other fittings or components before the plasterboard is applied. Indeed, it is conceivable that my new wall type can also be used in remodeling construction where it is feasible to install a cleat over a plaster or plasterboard covered ceiling. In any event, as will be apparent, the preformed soffits of the invention greatly reduce the time, skill and effort required for placement compared with the current practice of building-up soffits piece-by-piece on the job. While the two embodiments shown and described are the preferred ones, being the best modes known of carrying out the invention, the latter is not limited to those particular embodiments. Instead, the following claims are to be read as encompassing all adaptations and modifications of the invention falling within its spirit and scope.

I claim:

1. A preformed, composite soffit comprising: a length of molded material having a pair of legs to provide a soffit of generally L-shaped configuration in cross-section, the legs having a pair of exterior first planar surfaces at substantially right angles to each other and forming the outer faces of the legs and the soffit, the juncture between said first pair of planar surfaces constituting a first exterior longitudinal corner of the soffit and being formed by a furring strip, exterior surfaces of said furring strip forming portions of said first surfaces; a pair of exterior second planar surfaces extending transversely of respective ones of the first surfaces and forming the longitudinal outer end faces of the legs and the soffit, the junctures between respective ones of said first and second pairs of planar surfaces constituting second and third exterior longitudinal corners of the soffit, at least one of said second and third exterior longitudinal corners being formed by another furring strip, exterior surfaces of said other furring strip forming portions of said first and second surfaces of one of the legs; the furring strips extending the length of the soffit and secured to said material.

2. The soffit of claim 1 wherein both said exterior longitudinal corners are formed by furring strips extending the length of the soffit, exterior surfaces of the furring strips forming portions of respective ones of said first and second surfaces of the legs.

3. The soffit of claim 2 wherein all the furring strips are inset into said material such that said first and second surfaces of the soffit also include surface portions of said material; and wherein said length of material is an integral member.

4. The soffit of claim 3 wherein one of the legs of the soffit includes a series of access apertures therethrough spaced lengthwise along the soffit.

5. The soffit of claim 1 including a pair of exterior third planar surfaces at right angles to each other and to one of said first surfaces, the third surfaces intersecting the other of said first surfaces at a 45 degree angle, the third surfaces forming the transverse ends of the soffit.

6. The soffit of claim 5 wherein all the furring strips are inset into said material such that said first and second surfaces of the soffit also include surface portions of said material; and wherein said length of material is an integral member.

* * * * *